US006522111B2

(12) United States Patent
Zadeh et al.

(10) Patent No.: US 6,522,111 B2
(45) Date of Patent: Feb. 18, 2003

(54) LINEAR VOLTAGE REGULATOR USING ADAPTIVE BIASING

(75) Inventors: Ali Enayat Zadeh, Sierra Madre, CA (US); Yung-I Chang, Garden Grove, CA (US)

(73) Assignee: Linfinity Microelectronics, Irvine, CA (US)

( * ) Notice: Subject to any disclaimer, the term of this patent is extended or adjusted under 35 U.S.C. 154(b) by 0 days.

(21) Appl. No.: 09/941,408

(22) Filed: Aug. 28, 2001

(65) Prior Publication Data

US 2002/0130646 A1 Sep. 19, 2002

Related U.S. Application Data

(60) Provisional application No. 60/264,648, filed on Jan. 26, 2001.

(51) Int. Cl.[7] ..... G05F 1/573
(52) U.S. Cl. ..... 323/277
(58) Field of Search ..... 323/273, 274, 323/277

(56) References Cited

U.S. PATENT DOCUMENTS 5,274,323 A 12/1993 Dobkin et al. ..... 323/280
5,334,928 A 8/1994 Dobkin et al. ..... 323/280
5,410,241 A 4/1995 Cecil ..... 323/315
5,559,424 A * 9/1996 Wrathall et al. ..... 323/277
5,563,501 A 10/1996 Chan ..... 323/282
5,861,736 A 1/1999 Corsi et al. ..... 323/273
5,939,867 A * 8/1999 Capic et al. ..... 323/277
6,005,374 A 12/1999 Tasdighi ..... 323/273
6,157,176 A * 12/2000 Pulvirenti et al. ..... 323/277
6,188,212 B1 * 2/2001 Larson et al. ..... 323/274
6,201,375 B1 * 3/2001 Larson et al. ..... 323/277
6,300,749 B1 * 10/2001 Castelli et al. ..... 323/273

* cited by examiner

*Primary Examiner*—Jeffrey Sterrett
(74) *Attorney, Agent, or Firm*—Knobbe, Martens, Olson & Bear, LLP

(57) ABSTRACT

A linear voltage regulator, such as a low-dropout regulator, supplies power to one or more digital circuits within a computer system. The low-dropout regulator provides a substantially constant output voltage independent of loading conditions. The low-dropout regulator is biased at a relatively low operating current for steady-state operation to improve power efficiency of the low-dropout regulator. During a loading condition change, an adaptive biasing circuit senses the loading condition change and provides additional biasing current to momentarily increase the operating current of the low-dropout regulator to improve transient response.

18 Claims, 7 Drawing Sheets

LINEAR VOLTAGE REGULATOR USING ADAPTIVE BIASING

This application claims the benefit of U.S. Provisional Application No. 60/264,648, filed on Jan. 26, 2001, and titled Low-Dropout Regulator Using Adaptive Biasing.

BACKGROUND OF THE INVENTION

1. Field of the Invention

The present invention relates to power converters and, in particular, refers to a linear voltage regulator.

2. Description of the Related Art

A linear voltage regulator accepts a poorly specified and sometimes fluctuating input voltage and provides a substantially constant output voltage at a desirable level. The output voltage is used as a supply voltage for other circuits and is substantially independent of an output current (i.e., a load current). In one aspect, the load current level varies over time with substantially instantaneous transitions from one level to another level. For example, the linear voltage regulator supplies power to one or more digital circuits within a computer system which can be on or off depending on processing requirements. Thus, the load current level can be relatively high in one clock cycle and relatively low in a following clock cycle. As the digital circuits continue to improve and operate at higher frequencies, the transitions between clock cycles become faster thereby decreasing the transition time between load current levels.

One example of a linear voltage regulator is a low-dropout (LDO) regulator, wherein the LDO regulator is characterized by its ability to regulate the output voltage at a low voltage differential across an input terminal and an output terminal of the LDO regulator. A pass element (e.g., a power transistor) connects in series between the input terminal and the output terminal of the LDO regulator, wherein the power transistor provides the load current to the output terminal of the LDO regulator. The power transistor is generally large. In high-speed applications, the LDO regulator typically operates at a high quiescent current to drive the power transistor at a reasonable speed, but the result of utilizing a high quiescent current is inefficient power regulation.

SUMMARY OF THE INVENTION

The present invention solves these and other problems by providing a linear voltage regulator with adaptive biasing. The linear voltage regulator (e.g., a LDO regulator), accepts an input voltage at an input terminal and provides a substantially constant output voltage at an output terminal. In one embodiment, a LDO regulator includes a power transistor, a feedback network, a control circuit, and an adaptive biasing circuit. The power transistor connects in series between the input terminal and the output terminal of the LDO regulator, wherein the power transistor provides a load current to the output terminal while maintaining a selected output voltage. The feedback network is configured to sense the output voltage and generate a feedback voltage indicative of the output voltage. The control circuit is configured to receive the feedback voltage and to control the power transistor to maintain the output voltage at a substantially constant level (i.e., the selected level). Furthermore, the adaptive biasing circuit is configured to sense changes in the load current and alters an operating current of the LDO regulator in response.

In one embodiment, a method for adaptive biasing of a linear voltage regulator improves transient responses and power efficiency of the linear voltage regulator. The method includes biasing the linear voltage regulator at a relatively low operating current for steady-state operation, thus improving power efficiency of the linear voltage regulator. The method also includes detecting transients in a load current. The method further includes increasing the operating current of the linear voltage regulator to a relatively high level during the transients, thereby improving transient responses of the linear voltage regulator.

In one embodiment, the linear voltage regulator is a LDO regulator with a pass element interposed between an input terminal and an output terminal. A control circuit provides a control signal to drive the pass element to control an output current provided to the output terminal, thereby controlling a corresponding output voltage. In one embodiment, the control circuit is initially biased at a relatively low operating current. The control circuit receives a feedback signal from a feedback circuit. The feedback circuit senses the output voltage at the output terminal and develops the feedback voltage indicative thereof.

In one embodiment, the control circuit compares the feedback voltage to a reference voltage to produce the control signal. The level of the control signal changes as a load current changes to provide load regulation (i.e., maintain a substantially constant output voltage under changing load conditions). For example, as the load current (i.e., the current drawn by a load coupled to the output terminal) increases, the output voltage decreases unless the output current increases correspondingly. In one embodiment, the LDO regulator senses an increase in the load current and increases the operating current of the control circuit to a relatively high level temporarily. The relatively high operating current allows the control signal to transition relatively quickly, thereby improving the transient response of the LDO regulator.

These and other objects and advantages of the present invention will become more fully apparent from the following description taken in conjunction with the accompanying drawings.

DETAILED DESCRIPTION OF THE INVENTION

Figure 1:
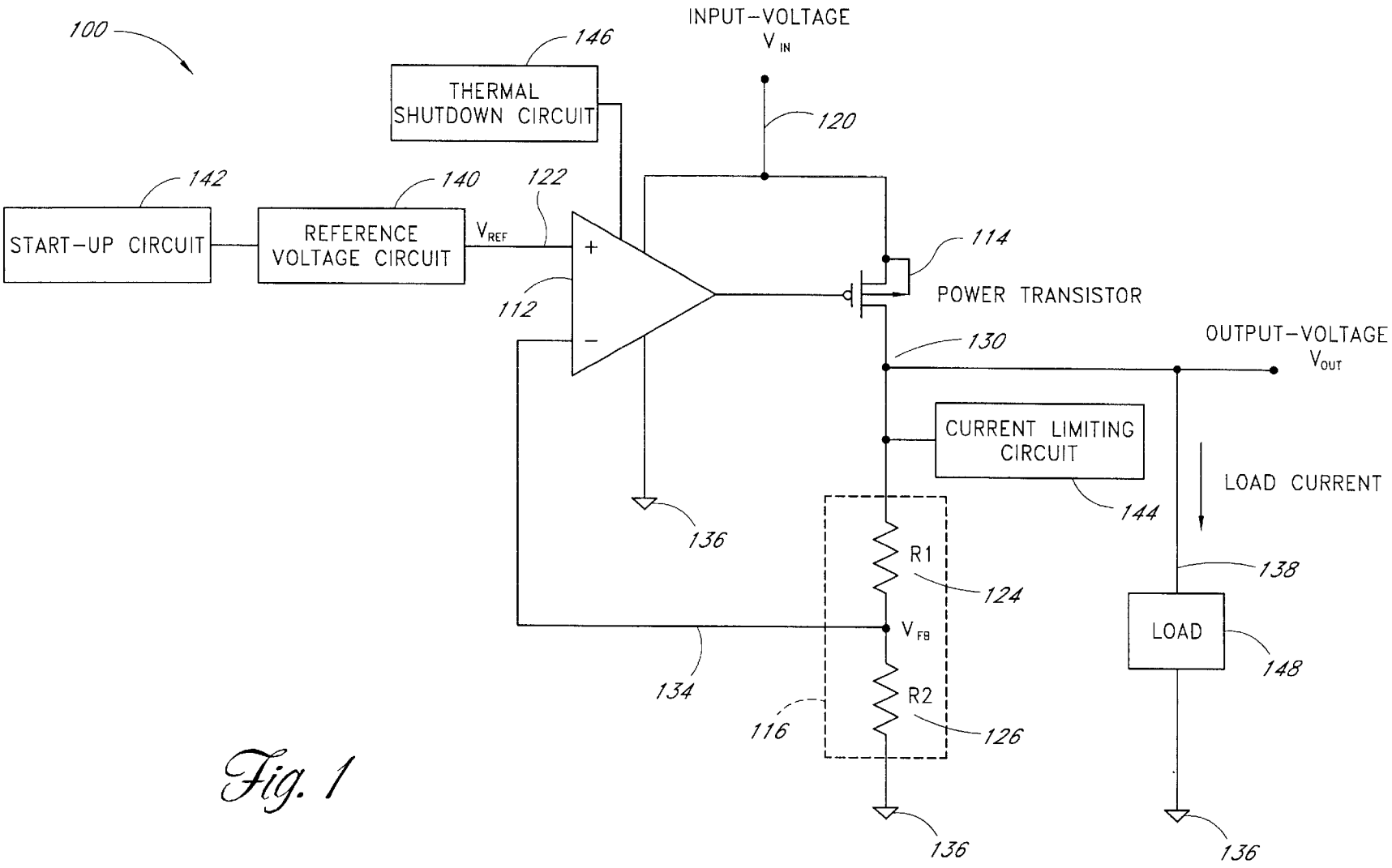
FIG. 1 is a block diagram illustrating a linear voltage regulator with adaptive biasing.

Embodiments of the present invention will be described hereinafter with reference to the drawings. FIG. 1 is a block diagram illustrating a linear voltage regulator 100 with adaptive biasing. An input voltage ($V_{IN}$) is provided to the linear voltage regulator 100 via a source (or input voltage) line 120 to establish an output voltage ($V_{OUT}$) on a supply (or output voltage) line 130. A load 148 couples to the supply line 130 and draws a load current on load line 138.

In one embodiment, the linear voltage regulator 100 is a low-dropout (LDO) regulator 100 with a pass element (e.g., a pass transistor or a power transistor) 114, a feedback network 116, and a control circuit 112. In one embodiment, the LDO regulator includes additional circuits, such as a reference voltage circuit 140, a start-up circuit 142, a thermal shutdown circuit 146, and a current limiting circuit 144.

The power transistor 114 connects in series between the source line 120 and the supply line 130. In one embodiment, the power transistor 114 is a p-channel metal-oxide semiconductor field-effect transistor (P-MOSFET). A source terminal and a body terminal of the power transistor 114 couple to the source line 120. A drain terminal of the power transistor 114 couples to the supply line 130.

The feedback network 116 couples to the supply line 130 to generate a feedback voltage ($V_{FB}$) on a feedback line 134. In one embodiment, the feedback network 116 is a resistor divider. A resistor R1 124 and a resistor R2 126 connect in series with respect to the supply line 130 and a circuit ground 136. For example, a first terminal of the resistor R1 124 connects to the supply line 130, and a second terminal of the resistor RI 124 connects to a first terminal of the resistor R2 126. A second terminal of the resistor R2 126 connects to the circuit ground 136. The feedback voltage is a voltage at the commonly connected terminals of the resistor R1 124 and the resistor R2 126.

In one embodiment, the control circuit 112 is an error amplifier. A reference voltage ($V_{REF}$) is provided to a non-inverting input of the error amplifier 112 via a reference line 122. The feedback voltage is provided to an inverting input of the error amplifier 112 via the feedback line 134. An output (e.g., an error signal) of the error amplifier 112 couples to the power transistor 114, such as a gate terminal of the P-MOSFET.

In one embodiment, the reference voltage is provided by the reference voltage circuit 140. For example, the reference voltage circuit 140 utilizes a zener diode. Alternately, the reference voltage circuit 140 is a band-gap reference circuit. The reference voltage circuit 140 provides a stable direct current (DC) voltage as the reference voltage. In one embodiment, the reference voltage circuit 140 has relatively limited current driving capability. However, the reference voltage circuit 140 has a relatively low temperature coefficient (i.e., the reference voltage remains relatively stable over temperature variations).

The LDO regulator 100 is a bi-stable circuit (i.e., has two stable operational modes). The LDO regulator 100 is designed to be stable at a desired operational mode. The LDO regulator 100 is also stable at a zero-current non-operational mode. Therefore, the start-up circuit 142 couples to the reference voltage circuit 140 in one embodiment to prevent the LDO regulator 100 from the zero-current non-operational mode. For example, the start-up circuit 142 activates to help the LDO regulator 100 reach the desired operational mode upon power-up or reset. After the LDO regulator 100 reaches the desired operational mode, the start-up circuit 142 becomes inactive and does not interfere with normal operations of the LDO regulator 100.

In one embodiment, the LDO regulator 100 includes fault-protection circuits to prevent the LDO regulator 100 from burning out or suffering permanent damage under accidental overload conditions. For example, the thermal shutdown circuit 146 protects against excessive junction temperatures. The thermal shutdown circuit 146 couples to the error amplifier 112 to sense junction temperatures of transistors in the error amplifier 112. The junction temperatures can increase above a safe level, causing excessive self-heating, when ambient temperature increases and/or current flows in the LDO regulator 100 increase. The thermal shutdown circuit 146 turns off the LDO regulator 100 when the junction temperature is above a predetermined limit that would likely damage the integrity of the LDO regulator chip or chip package.

The current limiting circuit 144 is a fault-protection circuit to prevent permanent damage to the LDO regulator 100 due to excessive or abnormal currents. For example, the LDO regulator 100 is designed with a capability to sink/source output currents at a maximum safe level. The LDO regulator 100 supplies power to diverse circuits, such as microprocessors, controllers, and/or memory circuits. In a particular instance or during an accidental overload, the load current can be higher than the maximum safe level. The current limiting circuit 144 limits the LDO regulator 100 from sourcing or sinking current beyond the maximum safe level.

The error amplifier 112, the pass transistor 114, and the feedback network 116 constitute a regulation loop which determines and maintains the level of the output voltage. In one embodiment, the output voltage level depends on the reference voltage level and component values in the feedback network 116. The output voltage level is not derived from the input voltage level. For example, the output voltage of the LDO regulator 100 is:

$$V_{OUT} = V_{REF}\left(1 + \frac{R_1}{R_2}\right).$$

In one embodiment, the reference voltage is generated internally (i.e., on the same chip as the LDO regulator 100) by a reference voltage circuit 140 described above. The reference voltage circuit 140 outputs a reference voltage which is relatively constant over input voltage variations and temperature variations.

In one embodiment, the LDO regulator 100 is fabricated on an integrated circuit chip. Integrated circuit technology facilitates design of relatively precise component value ratios. For example, component values (e.g., resistor values) vary with fabrication material and process. The same type of material is used to realize similar components on an integrated circuit chip, and the similar components are subject to substantially identical fabrication processes. Thus, any fabrication process variation affects the values of similar components in the same way, and ratios of values of similar component remain relatively constant in the integrated circuit chip. Accordingly, the output voltage of the LDO regulator 100 is relatively stable over input voltage variations, temperature variations, and process variations.

During normal (or steady-state) operations, the power transistor 114 is continuously conducting an output current which is a sum of a load current and a feedback current provided to the feedback network 116 or additional circuits, such as the current limiting current 144. In one embodiment, the feedback current is an insignificant portion of the output current, and the output current is substantially the load current.

One advantage of the LDO regulator 100 is a relatively low minimum input-output differential voltage (i.e., a relatively small minimal difference between the input voltage and the output voltage). The minimum input-output differential voltage (or dropout voltage) defines the minimum input voltage level to sustain a desired output voltage. The relatively low dropout voltage enables the LDO regulator 100 to operate over a wider range of input voltage levels. Furthermore, the relatively low dropout voltage extends the life of batteries. Many devices are powered by batteries, such as portable electronic devices and computer systems. Battery voltages gradually decrease during usage, and the relatively low dropout voltage facilitates operation at the lower battery voltages.

In the embodiment of FIG. 1, the dropout voltage is:

$$V_{DO}=I_{FET}\times R_{DS(ON)}.$$

$I_{FET}$ is the output current conducted by the power transistor 114. When the LDO regulator 100 is heavily loaded, the output current is substantially the load current. $R_{DS(ON)}$ is an output resistance of the power transistor 114 which can be designed to minimize the dropout voltage. For example, particular dimensions of the power transistor 114 are increased and/or special integrated circuit processes are used to decrease the output resistance of the power transistor 114, thereby decreasing the dropout voltage.

In one embodiment, the power transistor 114 occupies a substantial area of the integrated circuit chip. A relatively large geometry allows the power transistor 114 to exhibit a relatively small output resistance, such as tens of milli-ohms to hundreds of milli-ohms. However, the relatively large geometry also increases a parasitic gate capacitance of the power transistor 114.

Based on comparisons of the voltage reference and the feedback voltage, the error amplifier 112 drives the power transistor 114 to achieve the desired output voltage independent of the load current. For example, the load current can increase substantially instantaneously from a relatively small value to a relatively large value. If the power transistor 114 does not provide the increased current, the output voltage drops.

The LDO regulator 100 provides load regulation (i.e., ability to maintain a substantially constant output voltage level under changing load conditions) by providing an indication of a changed load to the error amplifier 112 via the feedback voltage. In one embodiment, the feedback voltage is a fraction of the output voltage. The error amplifier 112 drives the power transistor 114 harder (i.e., configures the power transistor 114 to increase output current) when the output voltage is below a desired level. Conversely, the error amplifier 112 configures the power transistor 114 to decrease output current when the output voltage is above a desired level, indicating excessive output current.

In one embodiment, the error amplifier 112 adjusts gate voltage of the power transistor 114 to control the output current level. The gate voltage is adjusted by charging or discharging the parasitic gate capacitance of the power transistor 114. In one embodiment, adaptive biasing in the error amplifier 112 improves charging or discharging speeds, thereby improving transient responses of the LDO regulator 100. For example, adaptive biasing temporarily increases the error amplifier's operating current to facilitate faster charging or discharging of the parasitic gate capacitance, thereby improving the response time of the LDO regulator 100 to changing load conditions.

In another embodiment, adaptive biasing in the error amplifier 112 enables a decrease in steady-state operating current of the error amplifier without sacrificing performance of the LDO regulator 100. Thus, the LDO regulator 100 is more current efficient, and lifetimes of batteries providing power to the LDO regulator 100 improve, which is advantageous in battery-powered products.

Current efficiency is a measure of how much the lifetime of a battery is degraded by the LDO regulator 100. Current efficiency is substantially the ratio of the load current to total current provided by the input voltage source, such as a battery. The battery life is limited by the total current. In one embodiment, the total current is substantially a sum of the load current and the operating (or quiescent) current ($I_Q$) of the LDO voltage regulator 100:

$$CurrentEfficiency=\frac{I_{LOAD}}{I_{TOTAL}}=\frac{I_{LOAD}}{I_{LOAD}+I_Q}$$

When the load current is significantly greater than the operating current, the load current determines battery life. When the load current is relatively low, the operating current becomes a factor in determining battery life. Low load current is a common condition in many battery-powered applications. Therefore, decreasing the operating current without sacrificing performance is an advantageous feature of the LDO regulator 100 with adaptive biasing.

Figure 2:
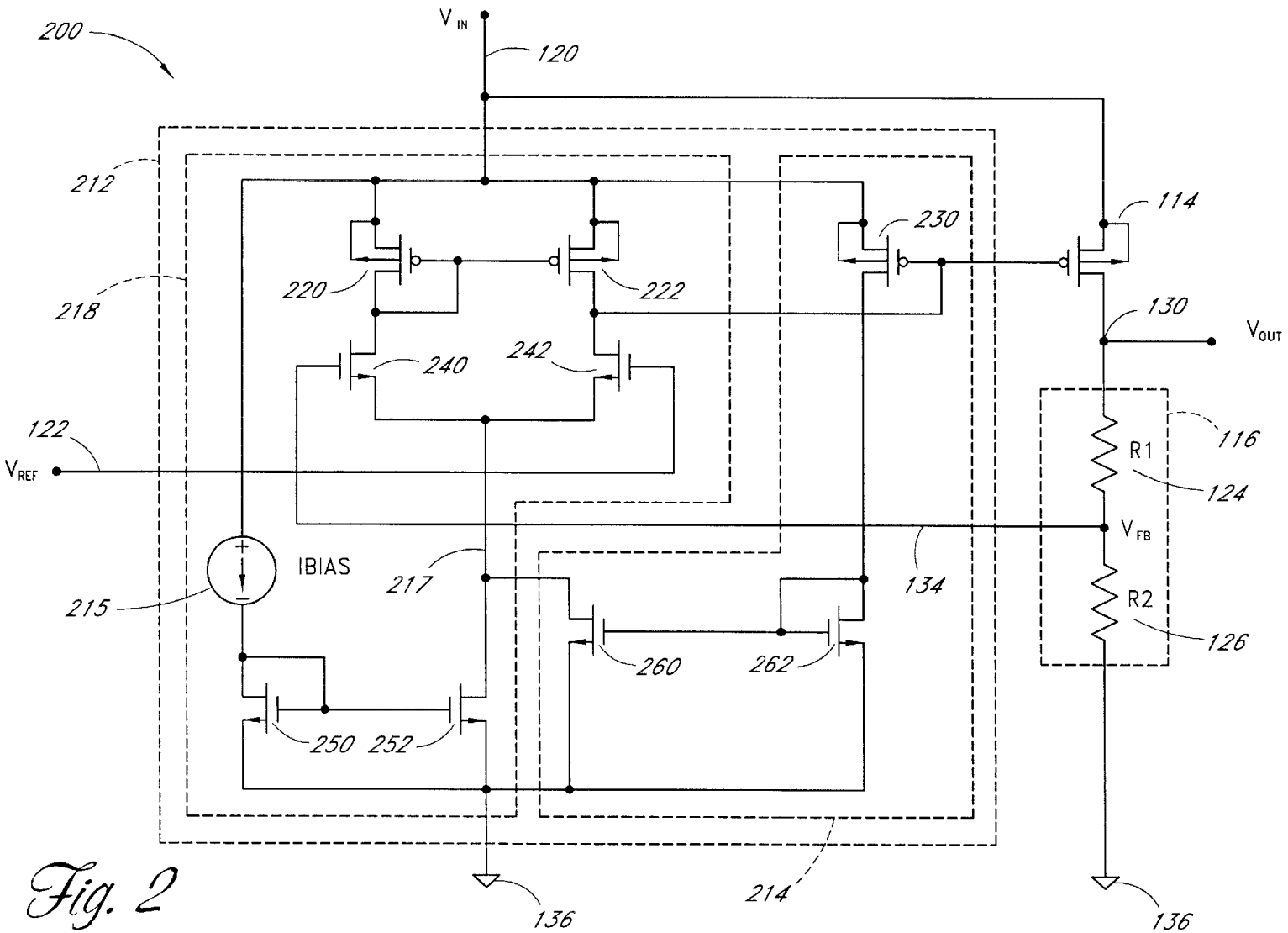
FIG. 2 is a schematic illustration of one embodiment of an LDO regulator.

FIG. 2 is a schematic illustration of one embodiment of an LDO regulator 200. An input voltage ($V_{IN}$) is provided on a source line 120, and an output voltage ($V_{OUT}$) is provided on a supply line 130. A power transistor 114 connects in series with the source line 120 and the supply line 130. A feedback network 116 couples to the supply line 130 and provides a feedback voltage on a feedback line 134. In one embodiment, the feedback network 116 is a resistor divider as described above.

The LDO regulator 200 has a control circuit 212 which includes a single-stage operational amplifier (op-amp) 218 and an adaptive biasing circuit 214. In one embodiment, the single-stage op-amp 218 includes differential pair transistors 240, 242, active load transistors 220, 222, a current source 215, and biasing transistors 250, 252. The adaptive biasing circuit 214 includes a sensing transistor 230 and mirror transistors 260, 262.

In one embodiment, the LDO regulator 200 is realized in complementary metal-oxide semiconductor (CMOS) technology. The biasing transistors 250, 252 and the differential pair transistors 240, 242 are N-MOSFETs. The biasing transistor 250 is configured as a diode (i.e., a drain terminal connects or shorts to a gate terminal). The current source 215 is coupled between the source line 120 and the drain terminal of the biasing transistor 250 and conducts a bias current (BIAS). A source terminal of the biasing transistor 250 connects to the circuit ground 136. The gate terminal of the biasing transistor 250 couples to a gate terminal of the biasing transistor 252 with a source terminal connected to the circuit ground 136. Thus, the biasing transistor 250 conducts substantially the bias current, and the biasing transistor 252 conducts a steady-state biasing current which has a current level that is substantially the same as or a multiple of the bias current. For example, if the biasing transistors 250, 252 are of the same geometry, the levels of the steady-state biasing current and the bias current are the same. However, if the biasing transistors 250, 252 are of different geometry, the current levels are correspondingly different.

A drain terminal of the biasing transistor 252 connects to source terminals of the differential pair transistors 240, 242 which are commonly connected. A reference voltage on a reference line 122 couples to a gate terminal of the transistor 242, and the feedback voltage on the feedback line 134 couples to a gate terminal of the transistor 240.

Active loads provide an efficient method for realizing high voltage gains in integrated circuits. In one embodiment, the active load transistors 220, 222 are P-MOSFETs. The active load transistor 220 is configured as a diode with a source terminal coupled to the source line 120, a drain terminal coupled to a drain terminal of the transistor 240, and a gate terminal coupled to a gate terminal of the active load transistor 222. A source terminal of the active load transistor 222 also couples to the source line 120, and a drain terminal couples to a drain terminal of the transistor 242.

The commonly connected drain terminals of the active load transistor 222 and the transistor 242 also couple to a gate terminal of the power transistor 114 to adjust the output current of the power transistor 114. For example, when the power transistor 114 is not providing enough output current, the output voltage decreases causing the feedback voltage to decrease as well. The differential pair transistors 240, 242 compare the feedback voltage to the reference voltage. Since the reference voltage is higher than the feedback voltage, the transistor 242 conducts more current than the transistor 240, causing voltage levels at the drain terminal of the transistor 242 as well as the gate terminal of the power transistor 114 to drop (or transition to a lower voltage). When the voltage level at the gate terminal of the power transistor 114 drops, the power transistor 114 provides more output current which brings the output voltage up.

In one embodiment, the adaptive biasing circuit 214 helps the voltage at the gate terminal of the power transistor 114 transition faster, thus providing a faster transient response. The sensing transistor 230 is a P-MOSFET with a gate terminal coupled to the gate terminal of the power transistor 114, a source terminal coupled to the source line 120 and a drain terminal coupled to a drain terminal of the mirror transistor 262.

The mirror transistors 260, 262 are N-MOSFETs. The mirror transistor 262 is configured as a diode with a source terminal coupled to the circuit ground 136 and a gate terminal coupled to a gate terminal of the mirror transistor 260. A source terminal of the mirror transistor 260 also couples to the circuit ground 136, and a drain terminal of the mirror transistor 260 couples to the commonly connected source terminals of the differential pair transistors 240, 242.

In one embodiment, the sensing transistor 230 conducts a sensed current that is a sub-multiple of the output current conducted by the power transistor 114. The mirror transistor 262 conducts the sensed current and the mirror transistor 260 conducts an adaptive biasing current which has a current level that is substantially the same as or a multiple of the sensed current in accordance with relative geometries of the mirror transistors 260, 262.

The adaptive biasing circuit 214 improves transient responses by making more current available to the differential pair transistors 240, 242 during a transient. For example, the differential pair transistors 240, 242 conduct substantially equal portions of a tail current during steady-state operation (i.e., when the output voltage and the output current are at the desired levels). In one embodiment, the biasing transistor 252 and the mirror transistor 260 are respective current sources coupled in parallel to the commonly connected source terminals of the differential pair transistors 240, 242. The tail current is a sum of the steady-state biasing current and the adaptive biasing current.

During steady-state operation, the level of the adaptive biasing current is insignificant. The tail current is substantially the steady-state biasing current. During a transient, the output current surges (or spikes) to stabilize the output voltage. The sensed current surges correspondingly. The adaptive biasing current becomes significant and adds to the tail current. Increased tail current allows the single-stage op-amp 218 to adjust the voltage at the gate terminal of the power transistor 114 faster, thereby improving the transient response of the LDO regulator 200. Since the adaptive biasing circuit 214 is relatively dormant during steady-state operation, the adaptive biasing circuit 214 improves performance without degrading efficiency. For example, the adaptive biasing circuit 214 does not increase power dissipation significantly.

Alternately, the adaptive biasing circuit 214 can improve efficiency without degrading performance. For example, the bias current of the single-stage op-amp 218 can be decreased to improve efficiency while the adaptive biasing circuit 214 compensates accordingly to maintain or to improve performance of the LDO regulator 200.

In addition to improving current efficiency, decreasing the bias current improves load regulation. Load regulation improves with increasing open-loop DC gain of the control circuit 212. The open-loop DC gain is inversely proportional to the bias current. The open-loop DC gain of an amplifying transistor gain-stage is expressed as:

$$A_V = g_m R_O$$

The transconductance ($g_m$) of an amplifying transistor gain-stage is proportional to the square-root of the bias current in the amplifying transistor, and the output resistance ($R_O$) of the amplifying transistor is inversely proportional to the bias current drain. Therefore, the overall transistor gain-stage is proportionally related to the inverse of the square root of the bias current in the amplifying transistor. As a result, if the bias current in the transistor gain-stage decreases, the gain or amplification of that stage increases. Thus, decreasing the bias current increases the open-loop DC gain which improves the load regulation.

Figure 3:
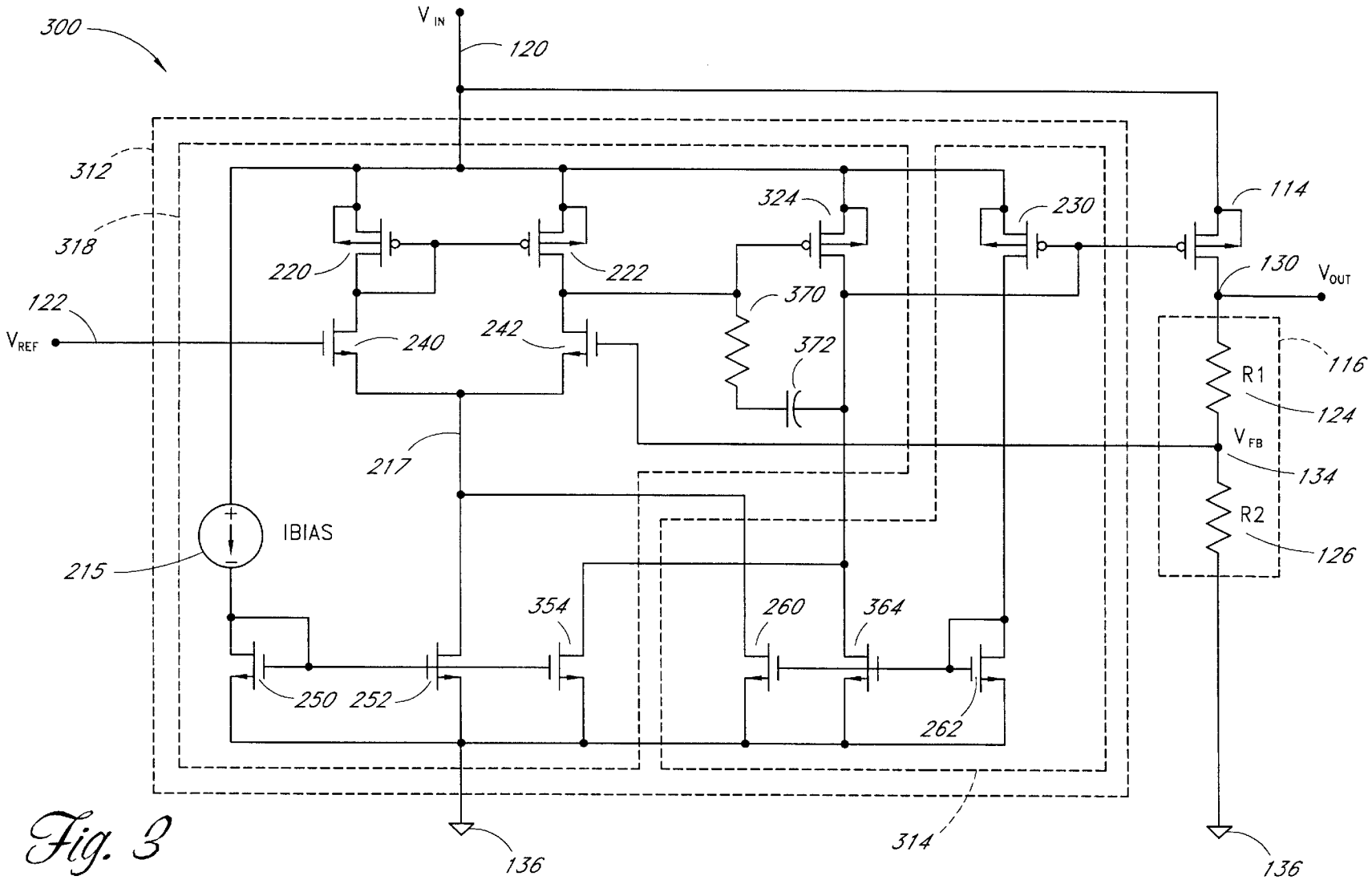
FIG. 3 is a schematic illustration of another embodiment of an LDO regulator.

FIG. 3 is a schematic illustration of another embodiment of an LDO regulator 300. The LDO regulator 300 operates in substantially the same manner as the LDO regulator 200 described above. The LDO regulator 300 has a control circuit 312 which includes a two-stage op-amp 318 and an adaptive biasing circuit 314.

The two-stage op-amp 318 includes a first stage described above as the single-stage op-amp 218 and a second stage interposed between the first stage and the power transistor 114 to provide additional gain, thus increasing the overall open-loop DC gain of the control circuit 312. The second stage includes a transistor (e.g., a P-MOSFET) 324 with a gate terminal coupled to the drain terminal of the transistor 242, a source terminal coupled to the source line 120, and a drain terminal coupled to the gate terminal of the power transistor 114. The drain terminal of the transistor 324 also couples to a drain terminal of a bias transistor (e.g., an N-MOSFET) 354. The bias transistor 354 has a gate terminal coupled to the gate terminal of the bias transistor 250 and a source terminal coupled to the circuit ground 136. The bias transistor 354 acts as a current source to provide a steady-state biasing current to the second stage of the two-stage op-amp 318.

In one embodiment, a frequency compensation network is added to stabilize the LDO regulator 300. For example, a compensating resistor 370 and a compensating capacitor 372 connect serially across the gate and the drain terminals of the transistor 324.

The adaptive biasing circuit 314 is substantially similar to the adaptive biasing circuit 214 described above with an additional mirror transistor 364. The mirror transistor 364 has a gate terminal coupled to the gate terminal of the mirror transistor 262, a source terminal coupled to the circuit ground 136, and a drain terminal coupled to the drain terminal of the transistor 324. The mirror transistor 364 acts as a current source to provide an adaptive biasing current to the second stage of the two-stage op-amp 318.

The control circuit 312 has a relatively high slew-rate and bandwidth to improve transient responses of the LDO regulator 300. During a transient when a load current increases relatively quickly (e.g., from zero milliampere to 100 milliamperes within a few microseconds), the output voltage dips until the LDO regulator 300 reacts to provide the new load current. In one embodiment, the operating current in a control loop of the LDO regulator 300 increases during the transient to restore the output voltage to a steady-state level relatively faster.

For example, when the load current increases substantially instantaneously, the power transistor 114 attempts to conduct a relatively large output current in response. The increased output current is detected by the sensed transistor 230 which produces a proportionate sensed current. The sensed current is replicated by the mirror transistors 262, 260, 364. The mirror transistors 260, 364 boost operating currents in respective stages of the two-stage op-amp 318 to a relatively high level momentarily, thus increasing the speed and bandwidth of the control circuit 312 during a transient situation. The control circuit 312 is capable of driving the power transistor 114 relatively hard during the transient situation. When the LDO regulator 300 returns to steady-state operation, current levels in the adaptive biasing circuit 314 are relatively minimal.

Figure 4:
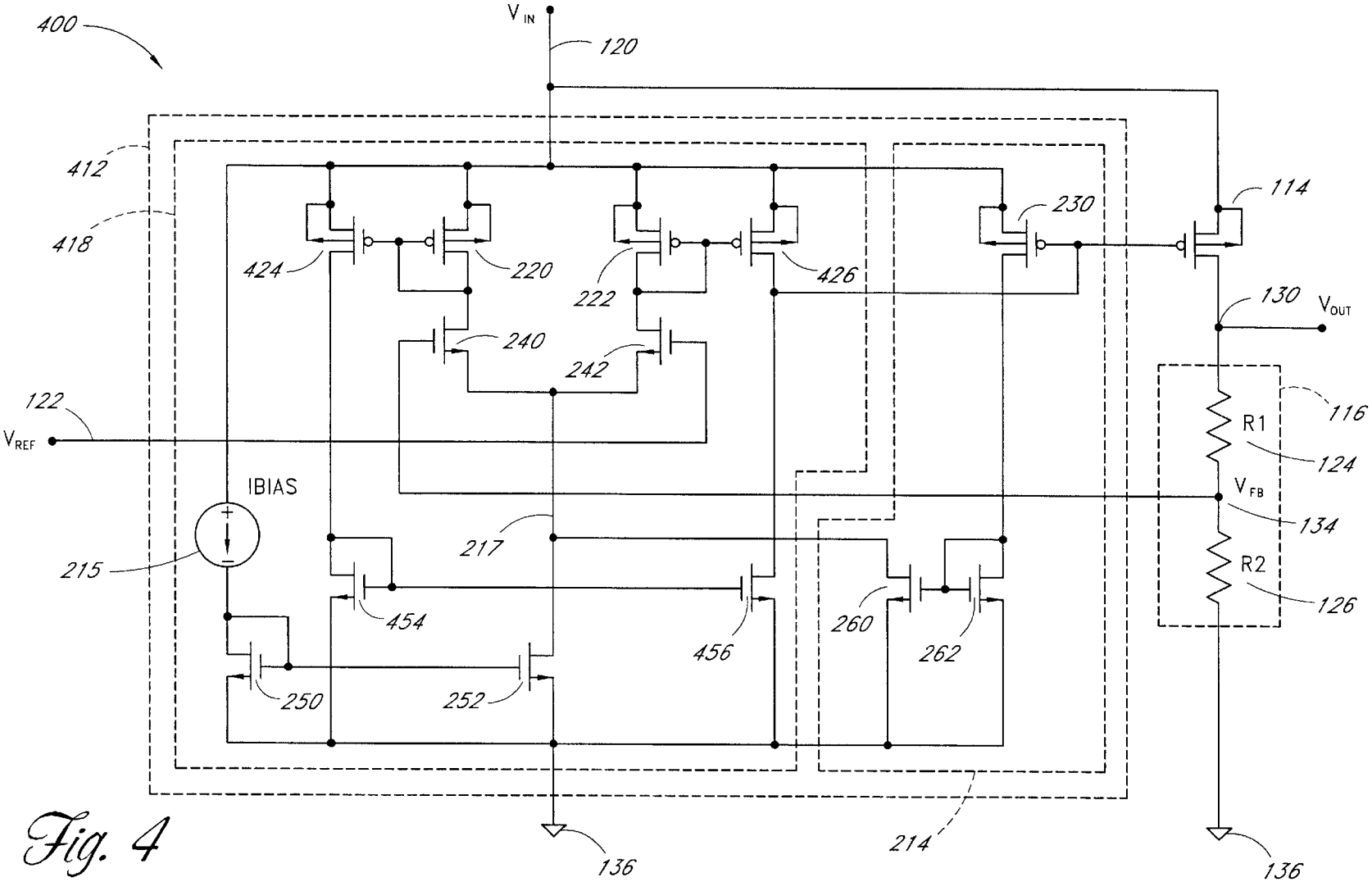
FIG. 4 is a schematic illustration of yet another embodiment of an LDO regulator.

FIG. 4 is a schematic illustration of yet another embodiment of an LDO regulator 400. The LDO regulator 400 has a control circuit 412 which includes an operational transconductance amplifier (OTA) 418 and the adaptive biasing circuit 214 described above. The OTA 418 includes transistors in a substantially similar configuration as described above in the single-stage op-amp 218.

However, the gate terminals of the active load transistors 220, 222 are not commonly connected. The active load transistors 220, 222 are configured as diodes in the OTA 418. The gate terminals of the active load transistors 220, 222 couple to respective gate terminals of output transistors (e.g., P-MOSFETs) 424, 426. The output transistors 424, 426 have source terminals coupled to the source line 120 and drain terminals coupled to respective mirror transistors (e.g., N-MOSFETs) 454, 456. The mirror transistor 454 is configured as a diode with a source terminal coupled to the circuit ground 136 and a gate terminal coupled to a gate terminal of the mirror transistor 456. A source terminal of the mirror transistor 456 also couples to the circuit ground 136.

Furthermore, the drain terminal of the output transistor 426 serve as an output of the OTA 418 to drive the gate terminal of the power transistor 114. The OTA 418 has high input impedance and high output impedance. The OTA 418 outputs a current signal based on an input voltage. For example, based on a difference between the feedback voltage and the reference voltage, the differential pair transistors 240, 242 conduct different currents which causes the output transistors 424, 426 to conduct different currents. However, the mirror transistor 456 is configured to conduct substantially the same current as the output transistor 424. Thus, the difference between the current levels of the output transistors 424, 426 is provided as a current output signal. In one embodiment, the current output signal charges or discharges the parasitic gate capacitance of the power transistor 114 to adjust the output current of the LDO regulator 400.

Figure 5A:
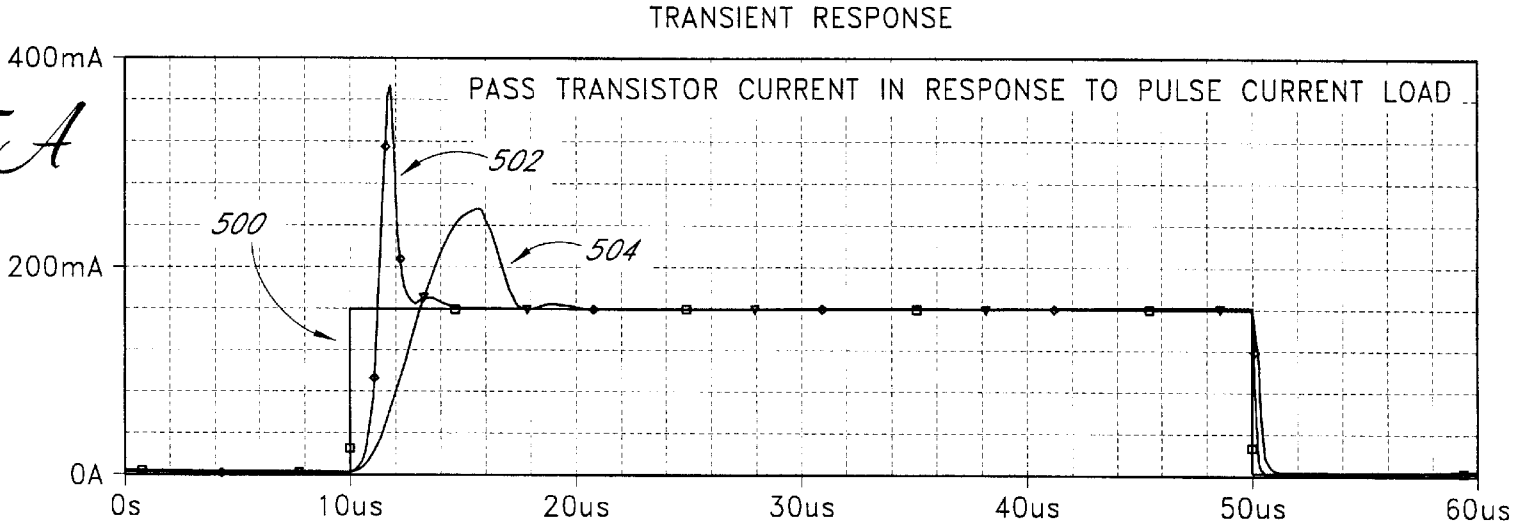
FIG. 5A illustrates waveforms of a load current and corresponding comparative currents through a pass element with respect to time.

FIG. 5A illustrates waveforms of a load current and corresponding comparative currents through a pass element with respect to time. A graph 500 represents a load current pulse which transitions from substantially zero ampere to approximately 160 milliamperes substantially instantaneously at about 10 microseconds. A graph 502 represents output current provided by the power transistor 114 in a LDO regulator with adaptive biasing. A graph 504 represents output current provided the power transistor 114 in a LDO regulator without adaptive biasing.

During a transient response, the output current of the LDO regulator spikes, indicating that the pass transistor 114 is driven relatively hard to return the LDO regulator to steady-state conditions after a load change. The output current in the LDO regulator with adaptive biasing increases relatively faster in response to increased load current, reaches a higher peak current, and advantageously settles to the new steady-state output current level faster than the output current in the LDO regulator without adaptive biasing. For example, the LDO regulator with adaptive biasing reaches steady state operation in half the amount of time.

Figure 5B:
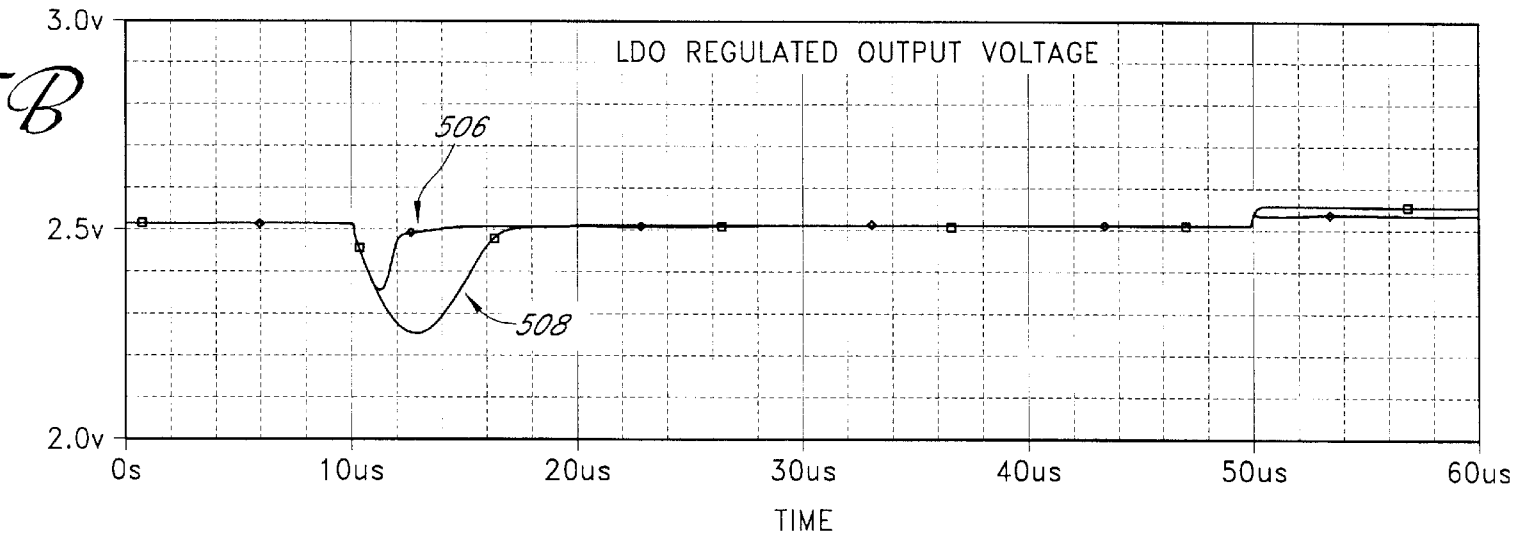
FIG. 5B illustrates waveforms of comparative output voltages with respect to time.

FIG. 5B illustrates waveforms of comparative output voltages with respect to time. A graph 506 represents the output voltage of the LDO regulator with adaptive biasing. A graph 508 represents the output voltage of the LDO regulator without adaptive biasing. In one embodiment, the steady-state (or desired) output voltage is about 2.5 volts. Both of the output voltages dip momentarily in response to a transient increase in the load current shown in FIG. 5A. However, the output voltage of the LDO regulator with adaptive biasing dips approximately half as low and recovers to the steady-state voltage level in about a third of the time as the LDO regulator without adaptive biasing.

Figure 6A:
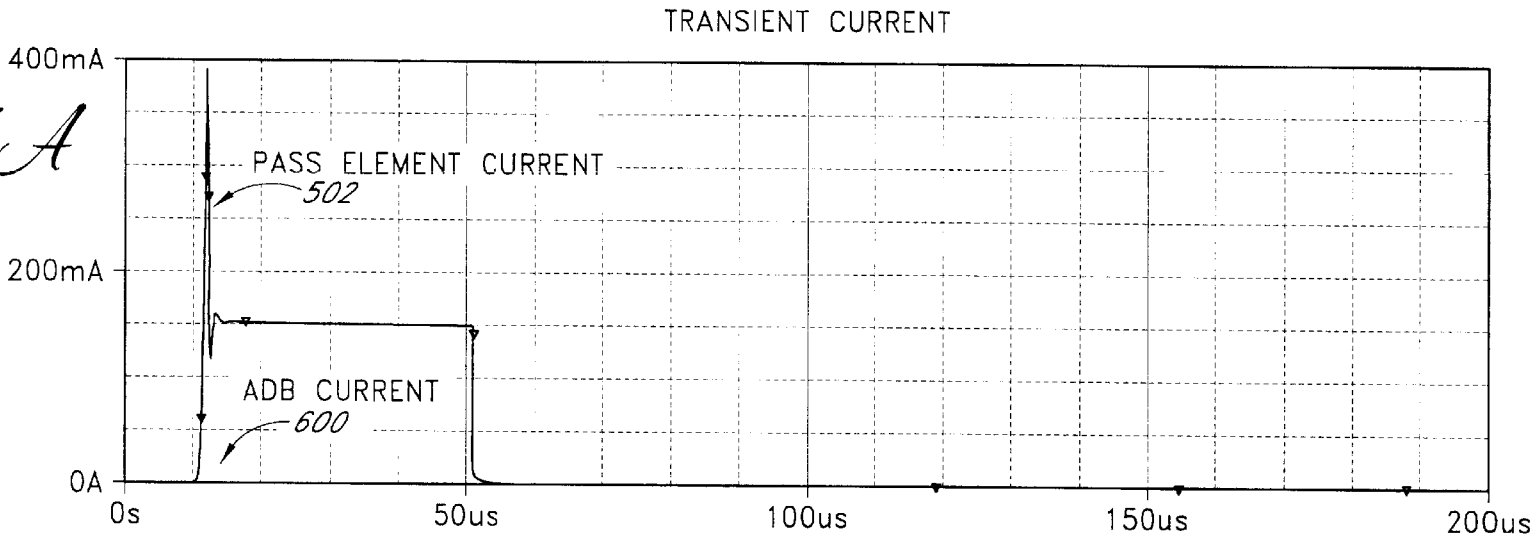
FIGS. 6A and 6B illustrate waveforms of various currents of the LDO regulator in the embodiment of FIG. 3 with respect to time.
Figure 6B:
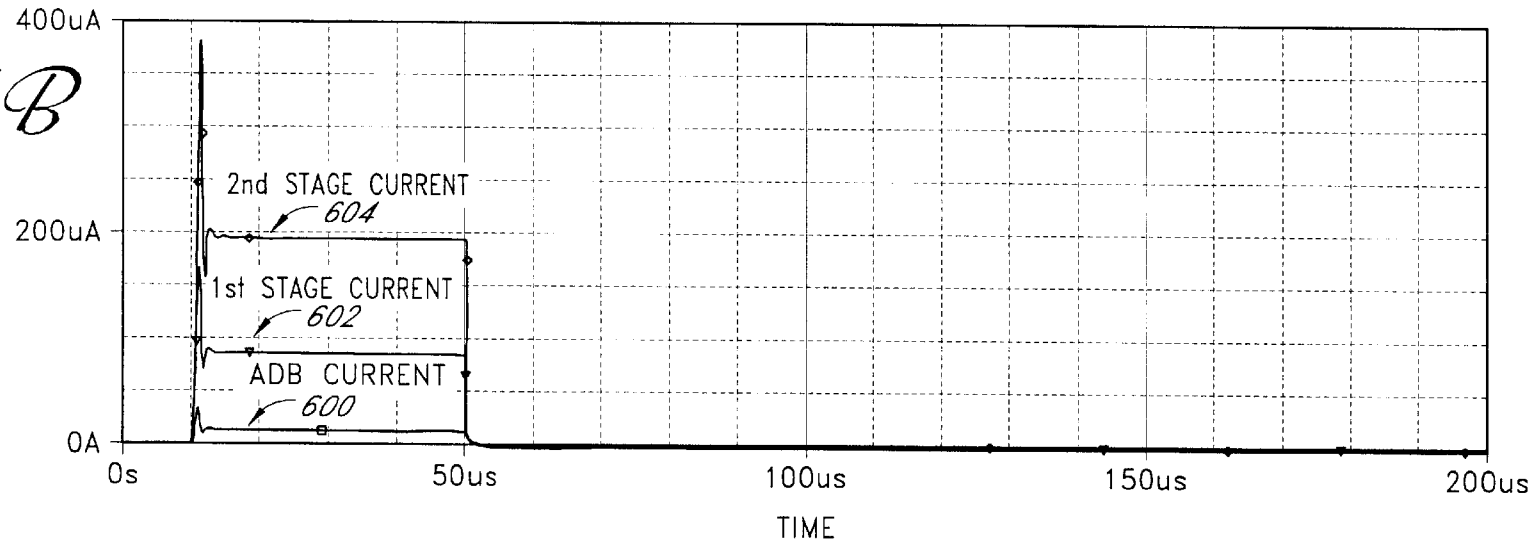

FIGS. 6A and 6B illustrate waveforms of various currents of the LDO regulator 300 in the embodiment of FIG. 3 with respect to time. A graph 600 is FIG. 6A represents current levels in the adaptive biasing circuit 314 which is relatively insignificant in comparison to the output current of the LDO regulator 300 shown in graph 502. Thus, the adaptive biasing circuit maintains or improves power efficiency of the LDO regulator 300.

Concurrently, the adaptive biasing circuit 314 makes a significant impact during a transient response of the LDO regulator 300. A graph 602 represents current levels in the first stage of the two-stage op-amp 318, and a graph 604 represents current levels in the second stage of the two-stage op-amp 318. The current levels in the two-stage op-amp 318 are substantially increased during a transient (i.e., the rising edge of the load current pulse), thereby increasing the gain-bandwidth (GBW) of the LDO regulator 300 during the transient response.

The adaptive biasing circuit 314 provides additional current to the two-stage op-amp 318 for the duration of the load current pulse. However, the additional current after the transient is advantageously minimal. The LDO regulator 300 utilizes minimal current to sustain steady-state operation at high or low load current. Therefore, minimal additional current conserves energy and extends lifetimes of batteries.

Figure 7A:
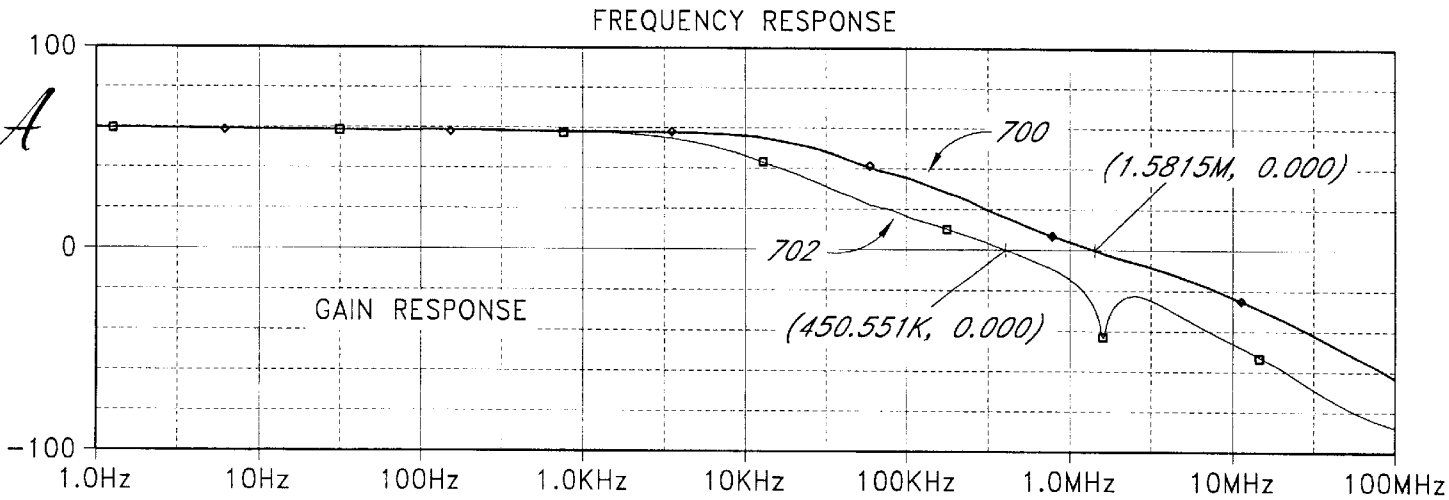
FIG. 7A illustrates comparative gain-frequency responses of LDO regulators with and without adaptive current biasing respectively.

FIG. 7A illustrates comparative gain-frequency responses of LDO regulators with and without adaptive biasing current respectively. A graph 700 represents a gain response of the LDO regulator 300. A graph 702 represents a gain response of a LDO regulator without adaptive biasing. The LDO regulator 300 advantageously has a unity GBW that is thrice the unity GBW of the LDO regulator without adaptive biasing. For example, the unity GBW of the LDO regulator without adaptive biasing is approximately 450 Kilohertz while the unity GBW of the LDO regulator 300 is approximately 1.5 Megahertz. An increase in unity GBW improves transient responses by substantially the same magnitude.

Figure 7B:
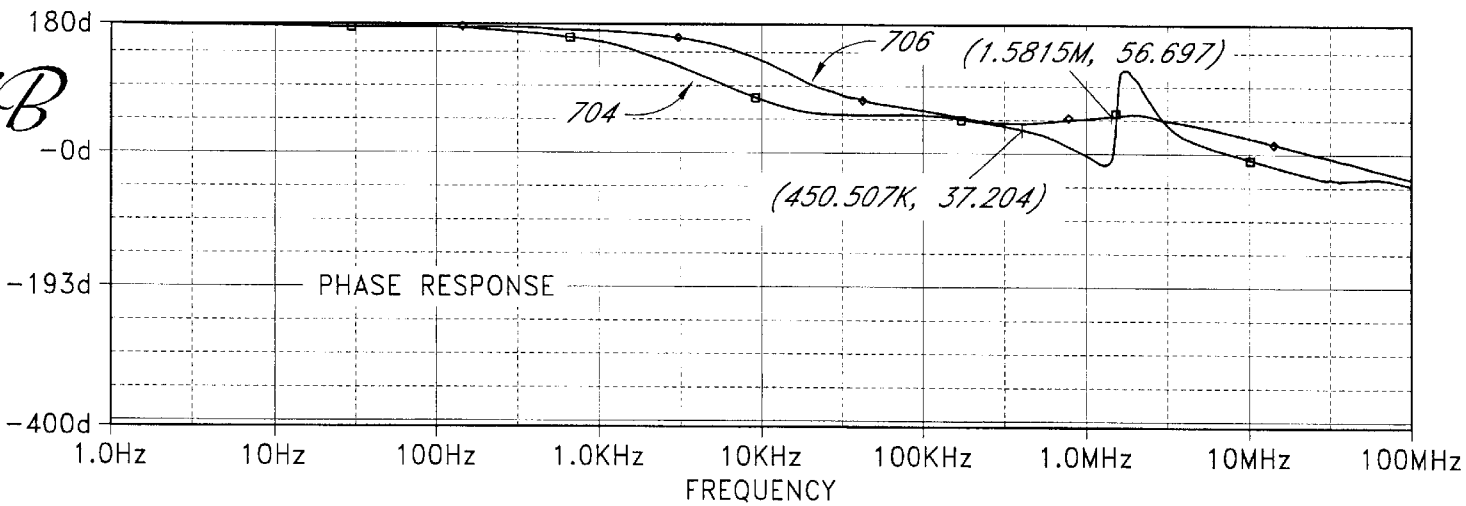
FIG. 7B illustrates comparative phase-frequency responses of LDO regulators with and without adaptive current biasing respectively.

FIG. 7B illustrates comparative phase-frequency responses of LDO regulators with and without adaptive biasing current respectively. A graph 704 represents a phase response of the LDO regulator 300. A graph 706 represents a phase response of a LDO regulator without adaptive biasing. The phase response of the LDO regulator 300 confirms stable operation over a wide frequency range.

In one embodiment, adaptive biasing improves power supply noise rejection. For example, an adaptive biasing circuit is used to compensate for a reduction in bias current in a control circuit 112 of a linear voltage regulator 100. Thus, the linear voltage regulator 100 with the adaptive biasing circuit and the reduced bias current has a substantially similar GBW as a linear voltage regulator without reduced bias current.

In addition to improving current efficiency and longevity of batteries in battery-operated applications, the reduction in bias current increases open loop DC gain of the control circuit 112. Higher open loop DC gain improves power supply noise rejection which is desirable for the linear regulator 100. The input voltage on the source line 120 is relatively noisy. Battery-operated devices, such as mobile telephones and personal digital assistants, desire supply voltages relatively free of spurious signals to protect signal integrity.

Although described above in connection with particular embodiments of the present invention, it should be understood that the descriptions of the embodiments are illustrative of the invention and are not intended to be limiting. Various modifications and applications may occur to those skilled in the art without departing from the true spirit and scope of the invention.

What is claimed is:

1. A linear voltage regulator which accepts a direct current input voltage at an input terminal and provides a direct current output voltage at an output terminal, the linear voltage regulator comprising:

a power transistor connected in series between the input terminal and the output terminal of the linear voltage regulator, wherein the power transistor provides a load current to the output terminal at a selected output voltage;

a feedback network configured to sense the output voltage, wherein the feedback network generates a feedback voltage;

a control circuit configured to receive the feedback voltage and to control the power transistor to maintain the selected output voltage at a substantially constant level; and a current sense circuit configured to sense the load current using a sensing transistor coupled to a control terminal of the power transistor, wherein the operating current of the control circuit increases in response to transient increases in the load current.

2. The device of claim 1, wherein the linear voltage regulator is a low-dropout voltage regulator.

3. The device of claim 1, wherein the linear voltage regulator supplies power to digital circuits within a computer system.

4. The device of claim 1, wherein the feedback network is a voltage divider circuit comprising at least two resistors.

5. The device of claim 1, wherein the control circuit is an error amplifier configured to compare the feedback voltage to a reference voltage and to produce an error signal to control the power transistor.

6. The device of claim 1, wherein the linear voltage regulator is fabricated on an integrated circuit chip using complementary metal-oxide semiconductor technology.

7. The device of claim 1, wherein the current sense circuit is coupled to the power transistor to detect the load current, produces a sense current proportional to the load current, and provides the sense current as additional operating current to the control circuit.

8. A low-dropout regulator which accepts an input voltage at an input terminal and provides an output voltage at an output terminal, the voltage regulator comprising:

a pass transistor connected between the input terminal and the output terminal of the voltage regulator, wherein the pass transistor conducts an output current;

a feedback network that senses the output voltage, wherein the feedback network provides a feedback voltage;

a control circuit that receives the feedback voltage and responds to changes in the feedback voltage by adjusting the pass transistor to conduct a different output current, wherein the control circuit is biased at a relatively low steady-state operating current; and an adaptive biasing circuit that senses the output current with a transistor coupled to a control terminal of the pass transistor and provides additional operating current to the control circuit using current mirror transistors during a transient increase in the output current.

9. The low-dropout regulator of claim 8, wherein the pass transistor is a p-channel metal-oxide semiconductor field effect transistor, and the adaptive biasing circuit is coupled to a gate terminal of the pass transistor to sense the output current.

10. The low-dropout regulator of claim 8, wherein the control circuit is a single-stage operational amplifier with differential pair input transistors, and the adaptive biasing circuit increases a tail current of the differential pair input transistors during the transient increase in the output current.

11. The low-dropout regulator of claim 8, wherein the control circuit is a two-stage operational amplifier, and the adaptive biasing circuit increases operating currents in each stage during the transient increase in the output current.

12. The low-dropout regulator of claim 8, wherein the control circuit is an operational transconductance amplifier.

13. A method of biasing a linear voltage regulator, the method comprising:

biasing the linear voltage regulator at a relatively low operating current for steady-state operations;

detecting transients in a load current using a sensing transistor; and providing additional operating current to the linear voltage regulator with current mirror transistors to result in relatively high operating current during the transients.

14. The method of claim 13 further comprising:

providing the load current via a power transistor to an output terminal of the linear voltage regulator at a selected output voltage;

sensing the output voltage and generating a feedback voltage; and receiving the feedback voltage and providing a control voltage to the power transistor so as to maintain the selected output voltage at a substantially constant level.

15. The method of claim 14, wherein the additional operating current is proportional to a current conducted by the power transistor during a transient response.

16. A method of biasing a linear voltage regulator so as to provide a selected direct current output voltage from a direct current input voltage, the method comprising:

providing an output current at an output terminal of the linear voltage regulator at the selected output voltage;

sensing the output voltage and generating a feedback voltage;

utilizing the feedback voltage to maintain the selected output voltage at a substantially constant level;

sensing a loading condition change via a surge in the output current and generating a mirrored current proportional to the surge in the output current; and increasing a steady-state biasing current of the linear voltage regulator with the mirrored current.

17. The method of claim 16, wherein the linear voltage regulator is a low-drop regulator with a power transistor coupled between an input terminal and the output terminal, and the power transistor conducts the output current.

18. A linear voltage regulator which accepts a direct current input voltage at an input terminal and provides a direct current output voltage at an output terminal, the linear voltage regulator comprising:

means for providing a load current to the output terminal at a selected output voltage;

means for sensing the output voltage and generating a corresponding feedback voltage;

means for receiving the feedback voltage and maintaining the selected output voltage at a substantially constant level; and means for actively sensing a loading condition change and to thereby increase an operating current of the linear voltage regulator.

* * * * *